US006901662B1

(12) United States Patent
Steinberg

(10) Patent No.: US 6,901,662 B1
(45) Date of Patent: Jun. 7, 2005

(54) ROTARY ELECTRIC SHAVER WITH ROTATING SCREENS

(76) Inventor: Hy Steinberg, 9646 W. McNab Rd., Tamarac, FL (US) 33321

( * ) Notice: Subject to any disclaimer, the term of this patent is extended or adjusted under 35 U.S.C. 154(b) by 26 days.

(21) Appl. No.: 10/900,441

(22) Filed: Jul. 28, 2004

(51) Int. Cl.[7] ..... B26B 19/14
(52) U.S. Cl. ..... 30/43.3; 30/43.5; 30/43.4
(58) Field of Search ..... 30/43.3–43.5, 30/346.51

(56) References Cited

U.S. PATENT DOCUMENTS

| | | | | |
|---|---|---|---|---|
| 2,283,834 A * | 5/1942 | Van Dam et al. | ..... | 30/43.5 |
| 2,396,181 A * | 3/1946 | Kerwer | ..... | 30/43.5 |
| 2,462,625 A * | 2/1949 | Florman | ..... | 30/43.3 |
| 4,038,747 A * | 8/1977 | Upton | ..... | 30/34.2 |
| 5,983,501 A * | 11/1999 | Izumi | ..... | 30/43.5 |
| 6,212,776 B1 * | 4/2001 | Izumi et al. | ..... | 30/43.4 |

* cited by examiner

*Primary Examiner*—Douglas D Watts

(57) ABSTRACT

A rotary electric shaver with a plurality of cutting heads that have planetary motion and circular motion for the outer screen elements of the cutting heads and an internal gear ring drive means.

7 Claims, 1 Drawing Sheet

ROTARY ELECTRIC SHAVER WITH ROTATING SCREENS

BACKGROUND OF THE INVENTION

1. Field of the Invention

The present invention pertains to rotary electric shavers with a plurality of circular cutting heads mounted on a rotating frame at the shaver's distal end and with rotating outer screens on the cutting heads.

2. Description of the Prior Art

The prior art of rotary electric shavers discloses numerous methods for combining oscillating, vibrating, circular and reciprocal movements to the inner, outer or both of the cutting head elements. A. Van Dam et al U.S. Pat. No. 2,283,834 discloses a circular movement of the outer screen element in a shaver having a single cutting head. A. Horowitz U.S. Pat. No. 2,308,920 discloses an oscillating movement of the outer screen element in a shaver with a single cutting head. Izumi et al U.S. Pat. No. 6,212,776 discloses a multi-headed rotary shaver with a circular movement for the outer screen elements of cutting heads that are fixed within a stationary head frame. The stationary head frame cannot produce the supplementary planetary movement of the outer screens that is essential to the improved cutting action of rotating screens as described in the present invention.

There are no disclosures of a rotary electric shaver with a plurality of cutting head screens that rotate in planetary motion, as in Steinberg U.S. Pat. No. 6,553,668, in concert with a circular motion for the outer screen elements.

SUMMARY OF THE INVENTION

The present invention compounds the planetary movement of a cutting head screen with a circular movement to produce a cutting action that automatically positions all hair ends for proper entry into the screen's slots or holes and increases the amount and closeness of hairs cut during movement of the shaver over the skin. A stationary, internal gear ring, linked to the shaver's revolving interior frame, provides a simple drive means for rotating all of the cutting head screens without the use of additional pinions or relay gears.

DETAILED DESCRIPTION OF THE INVENTION

In conventional rotary shavers, the direction of the friction force and the cutting action produced by movement of the cutting head screen against the skin surface is controlled entirely by the user's erratic and repetitious hand movements of the entire shaver body in various directions. The present invention replaces these repetitious hand movements by combining a planetary motion of the outer screen with a circular motion to automatically produce multi-directional friction forces that move all hair ends into the screen's slots or holes and accelerate its cutting action. The combined screen motion is particularly efficient in cutting randomly oriented hair ends.

Figure 1:
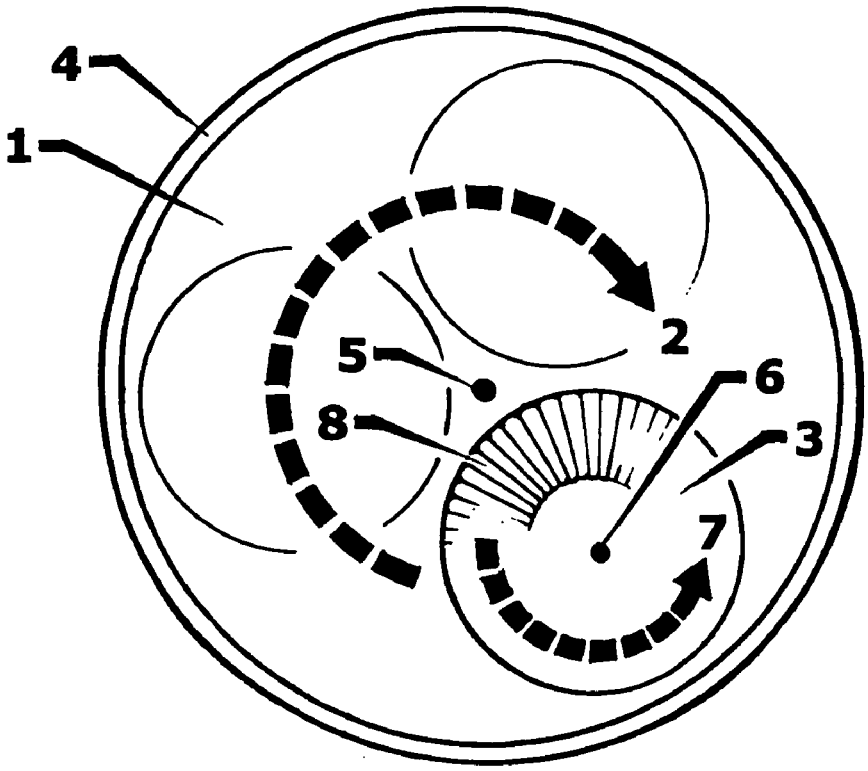
FIG. 1 is a diagrammatic view of a shaver's interface with the skin surface, illustrating the friction, stretching, twisting and hair-positioning action of the screen's circular movement within the rotating head frame of a triple-headed planetary shaver.

FIG. 1. Diagrammatically illustrates the interaction between the facial skin surface and a rotating head frame 1 with rotating cutting head screens 3 within the body 4 of a triple-headed, planetary shaver. The frictional force produced by each screen element 3 is circular and uniform in its traversed path 2 around the center 5 of the head frame 1. The cutting head screen 3 simultaneously rotates around its own center 6 and produces a rapidly alternating friction counterforce 7 that twists and stretches the skin, forcing all hair ends upright and into the screen's slots or hole perforations 8. Using the gear ring drive means described herein, together with a 2 inch shaver head diameter and 13/16 inch screen element diameter, the rotation speed of the screen element 3 is approximately twice the rotation speed of the head frame 1 that rotates in the opposite direction 2 within the upper shaver body 4. Furthermore, the shearing speed produced by the scissor action of the inner cutting element 12 (in FIG. 2) rotating against the opposite rotation of the outer screen 3, is the sum of both rotation speeds. This higher shearing speed increases the number of hair ends that can be cut by the planetary and circular rotation of the cutting head screens during hand movement of the shaver body.

The efficacy of the outer screen's circular rotation depends upon the speed of its planetary movement. As a result, the lowest combination of rotation speeds required to provide appreciable shaving improvement is a planetary head frame rotation of 1 revolution per second, combined with an outer screen rotation of approximately 2 revolutions per second. The maximum comfortable shaving improvement is attainable with a head frame rotation of 5 revolutions per second and a screen rotation of approximately 10 revolutions per second. Depending upon the outer screen's surface and design of its slotted or hole perforations, the friction produced by the highest speed of screen rotation may irritate users with particularly sensitive skin if the shaver is held motionless in one position for more than several seconds. Therefore, the most comfortable and practical range for head frame rotation is 2 to 4 revolutions per second, combined with a screen rotation speed of 4 to 8 revolutions per second. The optimum combined design speeds for the screen rotation 7 and the head frame rotation 2 should ultimately be determined by the specific targeted market for the shaver (older men, younger men, handicapped users, frequent users, users with very sensitive skin, or users with dense or random hair growth, etc).

Figure 2:
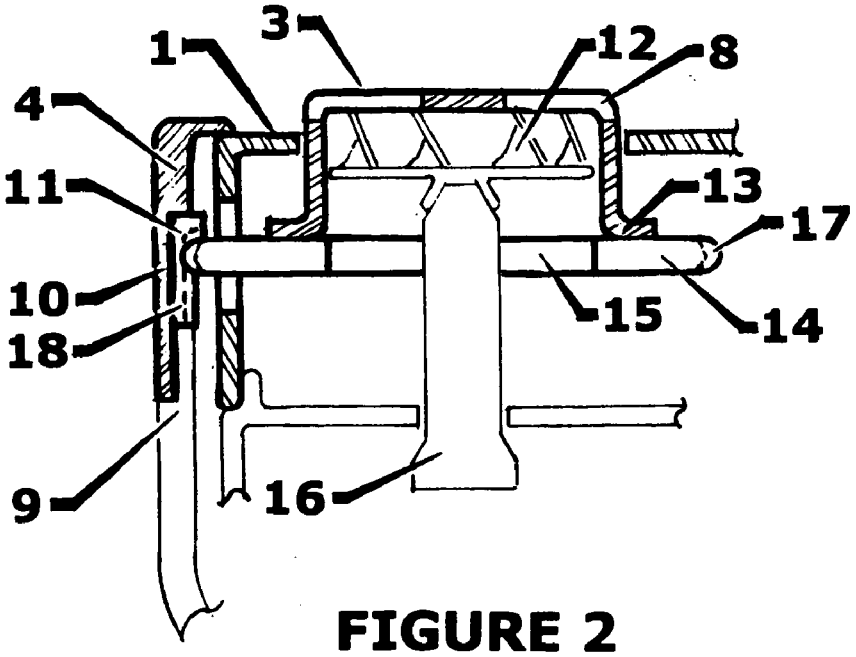
FIG. 2 is a partial cross-section of the distal, upper portion of the shaver body illustrating a preferred configuration of the drive means for rotating the outer screens of cutting heads mounted within a rotating frame.

FIG. 2 illustrates the preferred arrangement of the elements of this invention located within the upper, removable portion 4 of the shaver body 9. The motion of the rotating inner head frame 1 of the planetary, rotary shaver enables the internal gear ring 10 to transfer its rotation power to the cutting head's outer screen element 3. This gear ring 10, preferably of plastic composition, is either affixed to, or molded as an integral part of the interior surface of the removable portion 4 of the shaver body. The low speed design range for the cutting head frame 1 of the planetary shaver (from 1 to 8 revolutions per second) eliminates the need for additional pinions or relay gears to rotate the outer screens 3 within their effective range (from 2 to 11 revolutions per second) in the planetary shaver. The outer screens 3 of the cutting heads are configured with gear teeth that engage the internal gear ring 10. The stamped, metallic screen elements 3 of most conventional rotary shavers have a circular, pan shape that encompasses the inner cutting element 12 and a narrow, perimeter support collar 13. This pan-shaped metallic screen can be reconfigured with gear teeth on its perimeter by enlarging the width of the outer screen's collar 13 and stamping the shape of gear teeth into the outer edge of the collar. However, the preferred method for producing these gear teeth is to cement or mechanically attach a plastic spur gear 14 with a large bore opening 15 to an existing or widened collar 13 on the metallic screen.

If the drive pinions 16 for the shaver's cutting heads allow vertical movement or lateral tilting of the cutting head screen 3, the gear teeth 11 of the internal gear ring 10 can be curved concavely 11 and the teeth of the rotating screen can be curved convexly 17 to permit such movements without locking or disengaging the gears. The detachment of the upper body portion 4, for cleaning purposes, can be facilitated by a straight vertical profile on the lower edge 18 of the internal gear ring.

The embodiments of the invention described and illustrated herein are not meant to exclude other configurations or the substitution, addition, or modification of any of the elements or materials used, in order to practice the teachings that are within the scope of the claims of this invention.

I claim:

1. A rotary electric shaver with a plurality of circular cutting heads mounted on the exterior surface of a rotating frame within a removable upper body portion of said shaver wherein each cutting head is comprised of a rotating, inner cutting element and a contiguous, outer screen element that rotates around its own center.

2. A rotary electric shaver according to claim 1, wherein said outer screen element rotates at a speed between 120 rpm and 660 rpm.

3. A rotary electric shaver according to claim 1, wherein said outer screen element rotates in the opposite direction of the rotation of said inner cutting element.

4. A rotary electric shaver according to claim 1, wherein an internal gear ring is affixed to the interior surface of said upper body portion to provide a drive means for rotating said outer screen element around its own center.

5. A rotary electric shaver according to claim 4, wherein the vertical edge profiles of the teeth of said internal gear ring are concavely curved.

6. A rotary electric shaver according to claim 4, wherein the perimeter of said outer screen element is configured with gear teeth that mesh to the teeth of said internal gear ring.

7. A rotary electric shaver according to claim 4, wherein the perimeter of said screen element is joined to the inner bore opening of a plastic spur gear to form a collar with gear teeth that mesh to the teeth of said internal gear ring.

* * * * *